United States Patent [19]

Burton et al.

[11] Patent Number: 4,738,625

[45] Date of Patent: Apr. 19, 1988

[54] ELECTRICAL CONNECTORS FOR CIRCUIT PANELS

[75] Inventors: William H. Burton, Emmaus, Pa.; Clifford L. Winings, Lee's Summit, Mo.

[73] Assignee: Bell Telephone Laboratories, Inc., Murray Hill, N.J.

[21] Appl. No.: 913,039

[22] Filed: Sep. 29, 1986

[51] Int. Cl.[4] ..... H01R 9/09

[52] U.S. Cl. ..... 439/59; 439/66

[58] Field of Search ..... 339/17 L, 17 M, 17 LM, 339/17 CF, 75 MP, 176 MP, 91 R; 174/52 FP, 138 G; 361/403; 439/59-66

[56] References Cited

U.S. PATENT DOCUMENTS

| | | | |
|---|---|---|---|
| 3,205,471 | 9/1965 | Herrmann | 339/17 LM |
| 3,314,040 | 4/1967 | McKee | 339/75 MP |
| 3,601,775 | 8/1971 | Longenecker | 339/176 MP |
| 4,185,882 | 1/1980 | Johnson | 339/176 |
| 4,554,537 | 11/1985 | Dick | 340/775 |

FOREIGN PATENT DOCUMENTS

| | | | |
|---|---|---|---|
| 1143559 | 2/1963 | Fed. Rep. of Germany | 339/17 L |

OTHER PUBLICATIONS

*Connector and Interconnection Handbook*, vol. 2, pp. 4-26 to 4-30, (Fort Washington, PA., Electronic Connector Study Groups, 1979).

TKC Printed Circuit Connectors Catalog, vol. 2, pp. 1-6, (Huntington Beach, Calif., Ken Fleck Association, 1983).

"Plasma Panel Display Presents Unique Packaging Problems", *Electronic Packaging and Production*, Mar. 1984, pp. 132-134, Bilsback et al.

*Primary Examiner*—Neil Abrams

*Attorney, Agent, or Firm*—Herbert J. Winegar

[57] ABSTRACT

Disclosed is a connector module for making electrical contact between two essentially parallel boards which include contact pads on the edges. The connector includes at least one conductive member adapted to extend from a pad on one board to a corresponding pad on the other board. The connector also includes an insulating support member formed to extend from the top of one board, around the edge of that board, and to the top of the other board. This support member fixes the distance between the boards, permits the conductive members to make electrical contact for test purposes prior to clamping, and provides an appropriate clamping force for the connection to the first board.

11 Claims, 3 Drawing Sheets

ELECTRICAL CONNECTORS FOR CIRCUIT PANELS

BACKGROUND OF THE INVENTION

This invention relates to providing electrical connection between planar, essentially parallel, components.

In many electronic interconnect systems, it is necessary to provide electrical connection between essentially parallel surfaces of different components. These components can be at least two printed circuit boards representing different levels of interconnection in the system or can be a printed circuit board and some other type of component such as a display panel. As an example of the latter, ac plasma panel displays require electrical connection between glass covers and substrates and a printed circuit board so that the display can be appropriately addressed. In particular, a glass cover and glass substrate enclose a gas which is capable of being ionized when a bias is supplied to electrodes which are also formed on the substrate and cover. Contact pads are also protided on the facing surfaces of the substrate and cover, but outside the gas envelope, and are electrically connected to a printed circuit board which includes the necessary components for addressing the electrodes.

Several types of connectors have been proposed for providing electrical interconnection between parallel surfaces of a printed circuit board and another board or display component. These connectors are usually in the form of an elastomeric material consisting of alternating layers of conducting and nonconducting rubber (See, e.g., *Connectors and Interconnection Handbook,* Vol. 2, pp. 4–26 to 4–30 (Fort Washington Pa. Electronic Connector Study Groups, 1979)) or spring contacts (See, e.g., *TKC Printed Circuit Connectors Catalog,* Vol. 2, pp. 1–6, (Huntington Beach Calif., Ken Fleck Association, 1983)) which are placed between facing surfaces of the parallel components so as to interconnect corresponding contact pads. The parallel components and connectors are usually clamped together by screws running through holes in the components and a holder for the connector.

Such connectors are generally adequate for most applications. However, many problems exist, especially in the connection of plasma displays. For example, it is desirable to be able to provide a fairly stable connection between the cover, substrate and printed circuit board so that the device can be tested prior to actual clamping. Since the glass covers and substrates are fragile, some means is usually needed to prevent the clamping action from breaking these elements. It is also necessary in plasma displays to provide connection between the top of the substrate and the top of the printed circuit board (i.e. two non-facing surfaces).

Some connectors have been proposed to deal with some of the problems involved. For example, it has been proposed for LCD displays to provide a connector which includes a conductive member extending to the top surface of the display with an insulating support positioned on the opposite (bottom) surface of the display (See TKC Catalog cited above). Such a connector provides electrical contact from the top of the display to the printed wiring board. However, the contact force is apparently dependent upon the thickness of the display, and no provision is made for a padding element which would probably be required for use in conjunction with additional clamping which is desirable for a glass cover or substrate in a plasma display. It has also been proposed to provide electrical connection in a plasma display panel by means of a flexible circuit member extending between the glass and printed circuit board and mechanically attached thereto by spring clips on the edges of the glass and board (See, e.g., Bilsback et al. "Plasma Panel Display Presents Unique Packaging Problems," *Electronic Packaging and Production,* pp. 132–134 (March 1984)). Since the conductive element is a flex circuit, the distance between the glass and board must be fixed by some additional means. Also, padding elements which are not an integral part of the connector are required to prevent breakage of the glass and provide the appropriate contact force between tne conductive element and the glass or board.

It is, therefore, a primary object of the invention to provide an integral connector structure for making electrical contact between contact pads of different components with essentially parallel surfaces.

SUMMARY OF THE INVENTION

This and other objects are achieved in accordance with the invention which in one aspect is an electrical connector including an insulating support member comprising at least two contiguous U-shape portions. As least one of the portions defines a slot suitable for insertion therein of an electronic component having essentially planar major surfaces with contact pads on at least one surface. A conductive member is attached to the insulating support member and extends over a surface of at least one of the U-shaped portions.

In accordance with another aspect, the invention is an electronic assembly comprising at least two components, each having essentially planar major surfaces with contact pads formed on at least one surface. The components are in a spaced relationship having their major surfaces essentially parallel. Connectors are provide coupling the pads on the surface of one component to corresponding pads on the other component. The connectors each comprise an insulating support member having at least two contiguous U-shaped portions. One of the portions is clamped around an edge of one of the components. The connectors further include conductive members attached to the insulating support member and extending from a pad on one component to a corresponding pad on the other component.

BRIEF DESCRIPTION OF THE DRAWINGS

These and other features of the invention are delineated in detail in the following description. In the drawing.

It will be appreciated that, for purposes of illustration, these figures are not necessarily drawn to scale.

DETAILED DESCRIPTION OF THE INVENTION

Figure 1:
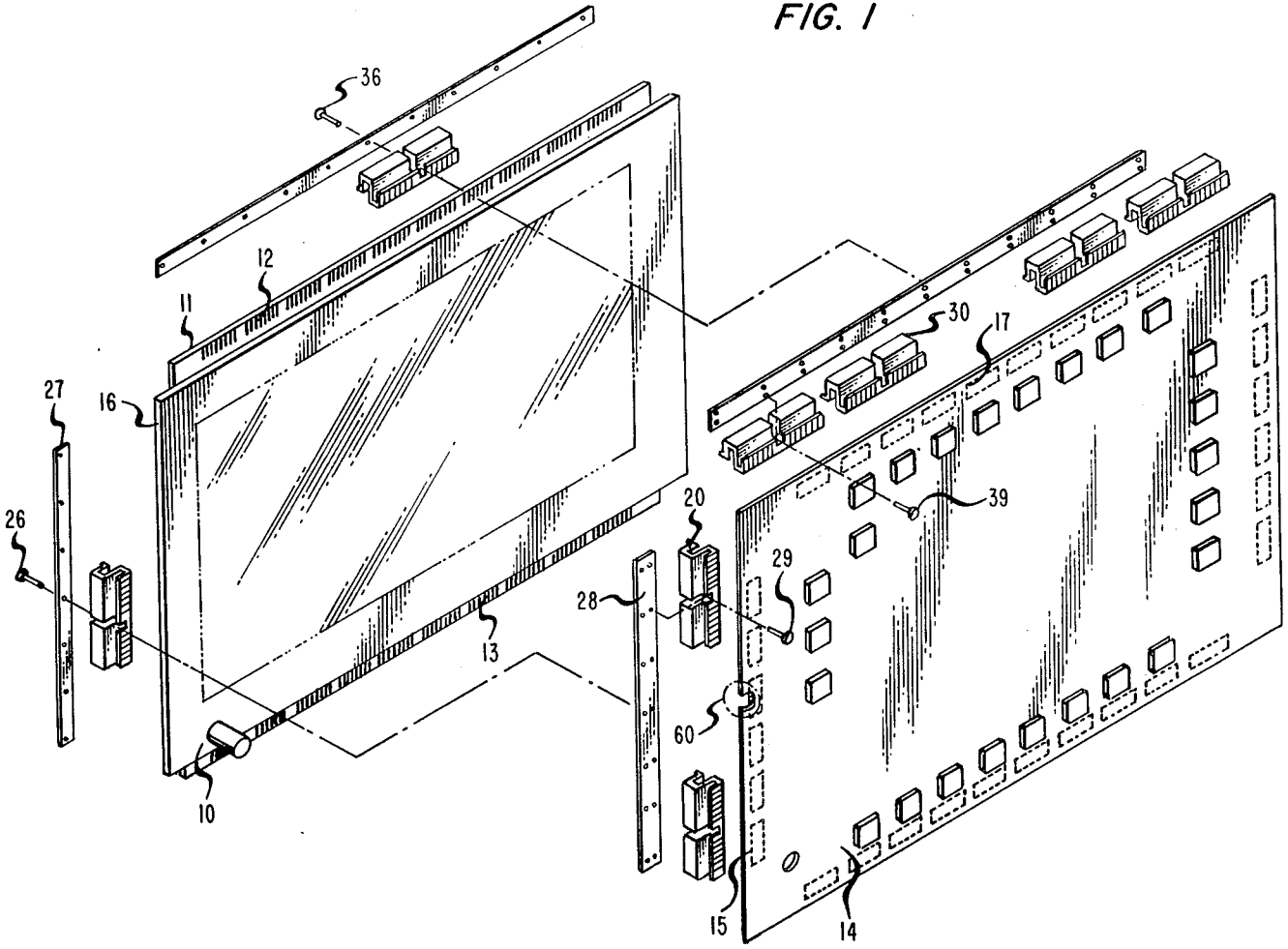
FIG. 1 is an exploded perspective view of an electronic assembly in accordance with an embodiment of one aspect of the invention.

FIG. 1 illustrates an electronic assembly including components having essentially planar major surfaces with contact pads formed on at least one surface of each component, where the components are spaced apart having their major surfaces essentially parallel to each other and electrical connection provided between corresponding pads on at least two components.

In this example, the assembly is a plasma panel display which includes two glass panels, 10 and 11, typically referred to as the substrate and cover, respectively, which are spaced apart to form a gap including an ionizable gas sealeo therein. This sealed unit is referred to as a "display panel". Each panel includes electrodes formed on the major surface in the gap to selectively ionize the gas and produce the display. (For a detailed discussion of a plasma display, see for example U.S. Pat. No. 4,554,537 issued to Dick.) The panels also each include a series of contact pads, e.g., 12 and 16, formed near at least one edge of the major surface facing the other panel. (Thus, in FIG. 1, only the pads on the cover panel, 11, are directly visible, but similar rows of pads, e.g., 16 are formed near the edges of the substrate, 10, at right angles to those of the cover.) The substrate and cover are bonded together by standard techniques.

Figure 4:
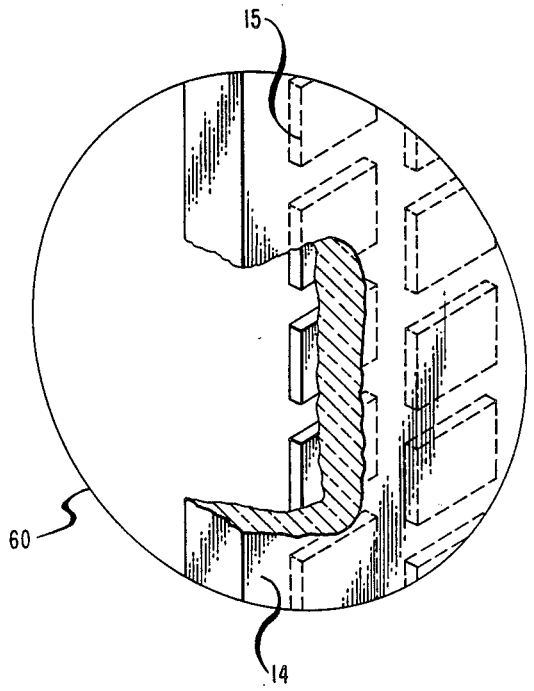
FIG. 4 is an enlarged view of a portion of the assembly in FIG. 1.

The display panel is positioned in a spaced relationship with a printed circuit board, 14, so that the major surfaces of each are essentially parallel. The board, 14, includes various electronic components thereon which provide the drive circuitry for the plasma panel display. These components are electrically connected to contact pads formed near the edges of the board on the major surface facing the display panel. Thus, these pads are not directly visible in the view of FIG. 1, but groups of such pads, are shown in phantom in the figure for purposes of illustration, and FIG. 4 gives an enlarged view of a portion, 60, of the board which is broken away for purposes of showing one group of pads such as 15. It will be noted that the pads are staggered for the purpose of providing a high density connection.

Typically, the cover measures approximately 11 inches×7 inches and the substrate measures approximately 12 inches×6 inches and each is approximately 0.12 inch thick. The printed circuit board is a standard type made of epoxy-glass with tin-lead plated copper conductors and measuring approximately 12 inches×7 inches and 0.06 inch thick. The substrate panel, 10, is typically placed approximately 0.25 inch from the surface of the printed wiring board. In a typical example, the contact pads on an edge of the glass panel are spaced approximately 0.030 inch from center-to-center in groups of 32. The pads are usually made of an appropriate conductive material and measure approximately 0.10 inch×0.02 inch with a thickness of 0.003 inch.

It will thus be appreciated that it is desired to form electrical connections between the pads on the display panel and corresponding pads on the printed circuit board. At the same time, it is desired to fix the distance between the display panel and board by some support means. Further, in assemblying the plasma panel display, it is convenient to have some way of connecting a printed circuit board to the display panel for testing purposes in such a way that it is easily disconnected if there is a defect. It is also convenient to be able to disassemble a printed circuit board from a completed display panel without disturbing the connections between the connectors and the display panel in the event that a defect appears some time after assembly.

The necessary electrical contact between the pads on the display panel and those on the printed circuit board is provided by two forms of a connector in accordance with the invention. One form, shown, for example as element 20, connects the pads on the substrate to the pads on the board, while the other form, shown for example as element 30, connects the pads on the cover to corresponding pads on the board.

Figure 2:
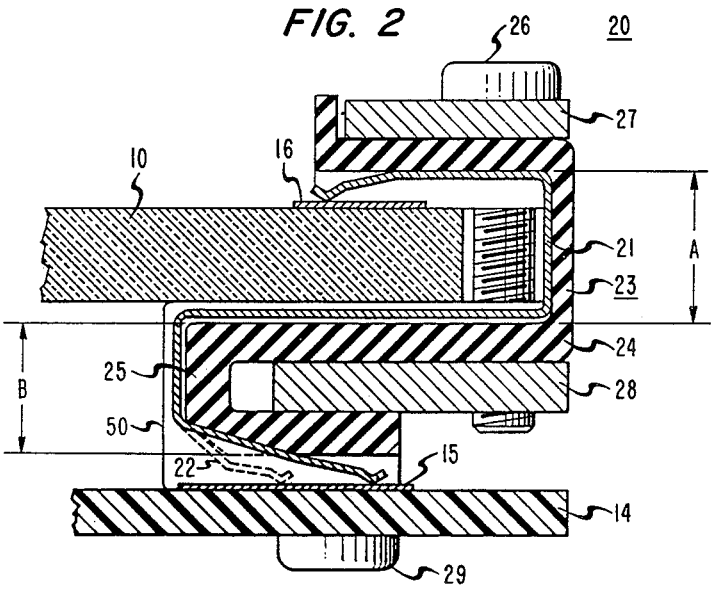
FIG. 2 is a cross-sectional view of an electrical connector and a portion of the assembly of FIG. 1 in accordance with an embodiment of a further aspect of the invention.

FIG. 2 illustrates, in cross-section, one of the connectors, 20, of FIG. 1, when the elements are fully assembled. The same elements in the two figures are similarly numbered. Each connector includes a plurality of conductive strips or springs, in this example, 64, which extend from a contact pad, e.g., 16, on the top surface of the substrate panel, 10, to a corresponding pad, e.g., 15, on the top surface of the printed circuit board 14. One of these conductive strips is illustrated as 21 in FIG. 2 and an adjacent strip is illustrated as 22 in phantom. It will be noted that the strip is formed in a generally S-shaped configuration to extend around the edge of the substrate to the top of the printed wiring board. In this example, each strip is blade of stainless-steel plated with tin-lead and is approximately 1.3 inches long, 0.014 inch wide and 0.010 inch thick. Of course, other conductive material may be used.

The conductive strips are mechanically attached to an integral, insulating support member, 23, which also extends from the top surface of the substrate, 10, to the top surface of the printed wiring board 14. The support is also generally S-shaped or may be considered, for purposes of discussion, to comprise two contiguous U-shaped portions, 24 and 25. The top U-shaped portion, 24, clips onto the edge of the substrate and supports the strip so that the strip makes contact with the pad, 16, on the top of the substrate. Prior to clamping of the connector in this embodiment with screws 26 and 29 as discussed below, the strip makes contact to the pad by spring forces. Subsequent to clamping, the contact force is essentially independent of the thickness of the substrate. It is also possible to make the contact force independent of the substrate thickness prior to clamping if the slot is made narrower than the substrate. A further advantage of this portion, 24, is that a fairly rigid contact is formed with the substrate pads prior to final clamping of the structure. Thus, the substrate panel can be electrically tested and the contacts easily removed if any defect occurs. The bottom portion, 25, of the support member, 23, serves in part as a guide for the conductive strips to make contact with the printed circuit board pads. Further, since the support is a rigid structure, this portion, 25, also fixes the distance between the substrate and the board when the components are fully assembled.

Each individual strip, 21, is inserted within a groove in the support member, 23, and separated from an adjacent strip, 22, by reans of a rib portion, 50, extending over the surface of the member, 23. The strips are typically attached to the support member by heating the surface to deform the rib portions until they extend over the strips. In this example, the support member was a molded plastic. The inside dimension, A, of the upper portion, 24, measured approximately 0.20 inch, while the outer dimension, B, of the lower portion, 25, measured approximately 0.18 inch. The total length of the two portions in the cross-sectional view of FIG. 2 was approximately 0.60 inch. The connector was built to accommodate 64 conductive strips, 21 and 22, and had a longitudinal dimension (perpendicular to the plane of FIG. 2) of approximately 2.1 inches.

As shown in FIGS. 1 and 2, the connector, 20, is clamped to the substrate, 10, by means of a screw, 26, threaded through a top plate, 27, which is placed on the top of portion 24. The screw extends through the slot portion of the connector adjacent to the edge of the substrate and through a nut plate, 28, which is placed adjacent to the bottom of portion, 24. The portion, 25, of the connector is clamped to the board, 14, by means of screw 29 which is threaded through the board, the bottom of portion 25, and through the portion of nut plate 28 which extends into the slot of portion 25. The top plate and nut plate are typically made of steel and extend the length of the portions of the substrate and board which include the contact pads. This length is typically approximately 7 inches. The thickness of the plates is approximately 0.05 inch. The width of top plate 27 is approximately 0.32 inch, and that of nut plate 28 is approximately 0.42 inch.

A further advantage of the insulating support member, 23, is that it provides padding between the plates, 27 and 28, and the glass panel to prevent breakage due to clamping. Thus, no additional elements are necessary to protect the glass.

Figure 3:
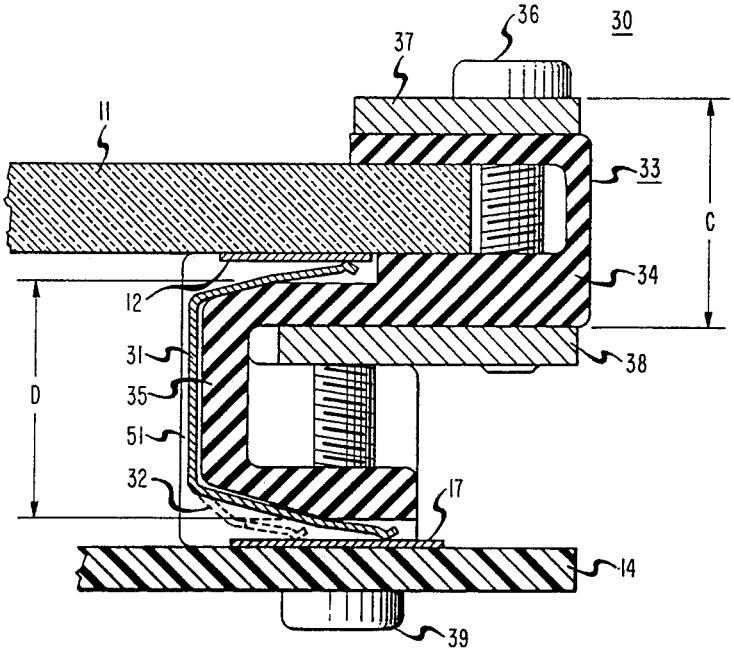
FIG. 3 is a cross-sectional view of an electrical connector and a portion of the electronic assembly in accordance with another embodiment of the further aspect of the invention.

FIG. 3 illustrates, in cross-section, another embodiment of the connector of the present invention which is useful for connecting the pads, such as 12, on the cover, 11, to corresponding pads, such as 17, on the surface of the printed circuit board, 14. This connector also includes conductive strips or springs, e.g., 31, extending from pads, e.g., (12) on the cover to pads, e.g., (17) on the board. However, it is apparent that since the pads are on surfaces of the cover and board which face each other, the strips are shorter and do not extend around the edge of the panel. In this example, each strip is approximately 0.7 inch long with the same width and thickness as the conductive strip 21 of connectors 20. Again, the connector accommodates several strips (64) one additional strip being shown in phantom as 32 for contacting adjacent pads (not shown).

The connector, 30, also includes an integral insulating support member, 33, which extends from the top of the cover, 11, around the edge of said cover and to the top surface of the board, 14. Again, it is useful for purposes of illustration to consider the support as comprising two contiguous U-shaped portions, 34 and 35. The upper portion, 34, includes a slot which clips onto the edge of the cover 11 and provides a clamping force thereto to hold the connector in place even before final clamping. This permits testing of the components on the cover with easy removal of the connectors if any defect is discovered. The other portion, 35, provides a guide for the conductive strips, (e.g., 31 and 32), which are attached thereto, as before, by deforming the rib portions, e.g., 51, of the insulating member which separate the strips. Since the support member is a fairly rigid structure, portion 35 also fixes the distance between the cover, 11, and board 14, which in this example is approximately 0.38 inch. In this example, the dimension, C, of the slot of the upper portion 34 is approximately 0.26 inch. The outer dimension, D, of the portion, 35, is approximately 0.30 inch. As before, the longitudinal dimension (perpendicular to the plane of FIG. 3) of the support is approximately 2.1 inches to accommodate several conductive strips. The length of the insulating support (in the plane of FIG. 3) is approximately 0.57 inch.

As in the case of connectors of FIG. 2, the connectors, 30 of FIG. 3, are finally clamped to the panel, 11, by means of a screw, 36, threaded through a top plate 37 and extending along the edge of the panel through a nut plate 38. The connector is clamped to the board, 14, by a screw, 39, extending through the board, through a portion of the bottom of the connector and through nut plate 38. (See also FIG. 1)

Again, the support, 33, also provides padding between the plates 37 and 38 and the glass panel, 11.

While the invention is most advantageously applied to plasma display panels as described above, it should be apparent that the invention may be utilized wherever it is desired to electrically connect two components having essentially planar, major surfaces where the surfaces are essentially parallel and there are contact pads on at least one surface near the edge. For example, both components could be printed circuit boards.

Various additional modifications will become apparent to those skilled in the art. All such variations which basically rely on the teachings through which the invention has advanced the art are considered within the scope of the invention.

What is claimed is:

1. An electrical connector comprising: an insulating support member comprising at least two contiguous U-shaped portions, at least one of said portions defining a slot suitable for insertion therein of a first electronic component having essentially planar major surfaces with contact pads on at least one surface and the other of said portions being adapted to make physical contact with a second component having essentially planar major surfaces with contact pads on at least one surface so that a fixed, predetermined distance is provided between the components when said second component is in a spaced, relationship and essentially coextensive with said first component with one of the U-shaped portions located between the components; and a conductive member attached to said insulating support member and extending over an internal surface of at least one of said U-shaped portions to electrically engage one of said contact pads on both components.

2. The device according to claim 1 wherein the conductive member extends over a surface of both U-shaped portions including the said slot.

3. The device according to claim 1 wherein the conductive member extends only over the surface of the U-shaped portion which does not define said slot.

4. The device according to claim 1 wherein the insulating support member comprises a molded plastic.

5. The device according to claim 2 wherein the portion including said slot provides a clamping force to said conductive member.

6. An electronic assembly comprising:

at least two components, each having essentially planar major surfaces with contact pads formed on at least one surface, said components being in a spaced relationship having their major surfaces essentially parallel and essentially coextensive; and connectors coupling the pads on the surface of one component to corresponding pads on the other component, said connectors each comprising an insulating support member having at least two contiguous U-shaped portions with one of said portions clamped around an edge of one of the components and the other of said portions making physical contact with the two components to fix the spaced relationship between the components with one of the U-shaped portions located between the components, and conductive members attached to the insulating support member and extending from a pad on one component to a corresponding pad on the other component.

7. The device according to claim 6 wherein at least one of said components comprises glass.

8. The device according to claim 7 wherein the two components comprise a plasma panel display.

9. The device according to claim 6 wherein the contact pads on the component clamped by a U-shpaed portion of the support member lie on a surface facing away from the surface including the contact pads of the other component, and the conductive strips extend around the edge clamped by the said U-shaped portion of the insulating support member.

10. The device according to claim 6 further comprising means for clamping the insulating support member to the two components.

11. An electrical connector for electrically interconnecting a pair of component boards having contact positioned thereon comprising:

an insulating member configured into a generally S-configuration forming a slot for receiving and supporting one of the component boards and a portion for making physical contact with the component boards in order to establish a juxtaposed essentially coextensive relationship with the other component board; and an electrical conducting spring formed into a generally S-shaped configuration interfitting with the configuration of the insulating member and with contact surfaces located at free ends thereof and insertably mounted on said insulating member with one of said contact surfaces positioned inside said slot to engage a corresponding contact pad of said one component board and another of said contact surfaces positioned on an outside surface of the S-shaped configuration of said insulating member to engage a corresponding contact pad of said other component board.

* * * * *